US006612969B2

(12) United States Patent
Eschenbach

(10) Patent No.: US 6,612,969 B2
(45) Date of Patent: Sep. 2, 2003

(54) VARIABLE STRIDE ELLIPTICAL EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 117 days.

(21) Appl. No.: 09/886,696

(22) Filed: Jun. 22, 2001

(65) Prior Publication Data

US 2001/0036886 A1 Nov. 1, 2001

Related U.S. Application Data

(63) Continuation-in-part of application No. 09/416,122, filed on Oct. 12, 1999, now Pat. No. 6,168,552, which is a continuation-in-part of application No. 09/246,889, filed on Feb. 8, 1999, now Pat. No. 6,024,676, which is a continuation-in-part of application No. 08/871,371, filed on Jun. 9, 1997, now Pat. No. 5,957,814.

(51) Int. Cl.[7] ..... A63B 69/16; A63B 22/04
(52) U.S. Cl. ..... 482/51; 482/52; 482/57
(58) Field of Search ..... 482/51–53, 57, 482/70, 79, 80

(56) References Cited

U.S. PATENT DOCUMENTS

| | | | | |
|---|---|---|---|---|
| 5,242,343 A | | 9/1993 | Miller | 482/57 |
| 5,423,729 A | | 6/1995 | Eschenbach | 482/70 |
| 5,685,804 A | | 11/1997 | Whan-Tong et al. | 482/51 |
| 5,692,994 A | | 12/1997 | Eschenbach | 482/57 |
| 5,788,610 A | | 8/1998 | Eschenbach | 482/52 |
| 5,836,854 A | | 11/1998 | Kuo | 482/52 |
| 5,893,820 A | | 4/1999 | Maresh et al. | 482/51 |
| 5,957,814 A | | 9/1999 | Eschenbach | 482/51 |
| 5,997,445 A | | 12/1999 | Maresh et al. | 482/70 |
| 6,042,512 A | * | 3/2000 | Eschenbach | 482/52 |
| 6,045,488 A | * | 4/2000 | Eschenbach | 482/52 |
| 6,077,198 A | * | 6/2000 | Eschenbach | 482/52 |
| 6,146,313 A | | 11/2000 | Whan-Tong et al. | 482/51 |
| 6,254,514 B1 | * | 7/2001 | Maresh et al. | 482/52 |
| 6,409,632 B1 | * | 6/2002 | Eschenbach | 482/52 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Elliptical trainers guide the feet along a generally elliptical shaped curve to simulate the motions of jogging and climbing. Existing elliptical trainers consume excessive floor-space and often lack adjustable pedal motion. The present invention is an improved elliptical exercise machine capable of extended exercise with adjustable pedal motion. Adjustment can be automatic during operation or manual. Handles are provided for coordinated arm exercise.

31 Claims, 3 Drawing Sheets

VARIABLE STRIDE ELLIPTICAL EXERCISE APPARATUS

This application is a Continuation-in-Part of application Ser. No. 09/416,122 filed Oct. 12, 1999, now U.S. Pat. No. 6,168,552 which is a Continuation-in-Part of Ser. No. 09/246,889 filed Feb. 8, 1999, now U.S. Pat. No. 6,024,676 which is a Continuation-in-Part of U.S. Ser. No. 08/871,371, filed Jun. 9, 1997, now U.S. Pat. No. 5,957,814.

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. Pedal stride is adjustable.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a linkage to modify the crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise configurations have appeared in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Maresh in U.S. Pat. No. 5,897,463 shows a foot platform with parallel movement as the the foot platform follows an oval path. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

Maresh et al. in U.S. Pat. Nos. 5,893,820 and 5,997,445 shows adjustable lift elliptical cross trainers. Kuo U.S. Pat. No. 5,836,854 shows a foot support member driven by a crank and guided on one end by a linkage hanging from a "Z" shaped bar that may be adjusted. Whan-Tong et al. in U.S. Pat. Nos. 5,685,804 and 6,146,313 shows a foot support member driven by a simple crank having an adjustable ramp to vary pedal lift. Eschenbach in U.S. Pat. No. 5,692,994 shows an elliptical cross trainer which has an adjustable upright support member which allows variable pedal motion.

There is a need for a pedal operated exercise machine that can be safely operated in the standup position whereby the arms and legs can be exercised with the feet moving through a generally elliptical movement that can be adjusted.

It is one objective of this invention to provide an elliptical pedal movement with a control assembly that provides pedal stride adjustment. Another object of this invention is to provide an oblong pedal path that can be adjusted during operation of the exercise machine by a control system. Yet another object of this invention is to provide arm exercise that is coordinated with the pedal movement.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot generally in contact with the pedal. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being supported by a foot support member. The foot support member has a first portion supported by a guide which is pivoted to a framework and a second portion which is supported by a roller. The first portion of the foot support member has a back and forth movement while the second portion has up and down movement causing the pedal to move along an elongate curve.

A crank is rotatably connected to the framework and protrudes on each side of the exercise machine. A pair of rocker links are pivotally connected to the framework. A pair of coupler links connect each rocker link to the crank. Each rocker link, coupler link and crank are considered crank assemblies. A coupler extension is attached to the coupler link to support the roller in rollable contact with the foot support member. The crank assembly causes the second portion of the foot support member to have up and down movement.

A guide extension is attached generally orthogonal to the guide and a rocker extension is attached generally orthogonal to the rocker link. A control link connects the guide extension to the rocker link extension with pivots. Either pivot can be movable along the extensions to adjust the back and forth movement of the guide. The adjustment can be manual as in this embodiment or automatic by actuator. The pivot on each guide extension is movable by a screw thread and knob positioned within easy reach of the operator.

Arm exercise is provided with handles attached to each guide. When the foot is forward, the handle corresponding to that foot is generally rearward.

Load resistance is imposed upon the crank through pulleys and belt engaged with a flywheel. A friction belt is connected to the flywheel for adjustable load resistance. A control system within easy reach of the operator can adjust the belt tension during operation of the exercise machine. Other forms of load resistance such as alternator, magnetic, air, belt, etc. may also be used.

In an alternate embodiment, the roller is rollably connected to the crank to support the foot support member with an up and down movement. An actuator is attached to each rocker link extension to move a rocker pivot collar containing the rocker pivot closer or further away from the rocker link to change the pedal stride. A control system positioned near the operator can adjust the actuators during operation to reposition the rocker pivot collars for a change in pedal stride length. The remainder of the exercise machine is similar to the preferred embodiment.

Actuators could be attached to the guide extension to move the pivot common to the control link and guide extension to produce adjustable stride. Actuators with control system or manual adjustment can be applied to either embodiment as described herein.

In summary, this invention provides the operator with stable foot pedal support having motions that simulate running, jogging and climbing with very low joint impact and upper body exercise. The pedal motion is adjustable during operation to change the pedal stride length and and geometry of the elongate curve. Arm exercise is coordinated with the pedal motion and changes with the pedal motion adjustment.

DETAILED DESCRIPTION OF THE EMBODIMENTS

Figure 1:
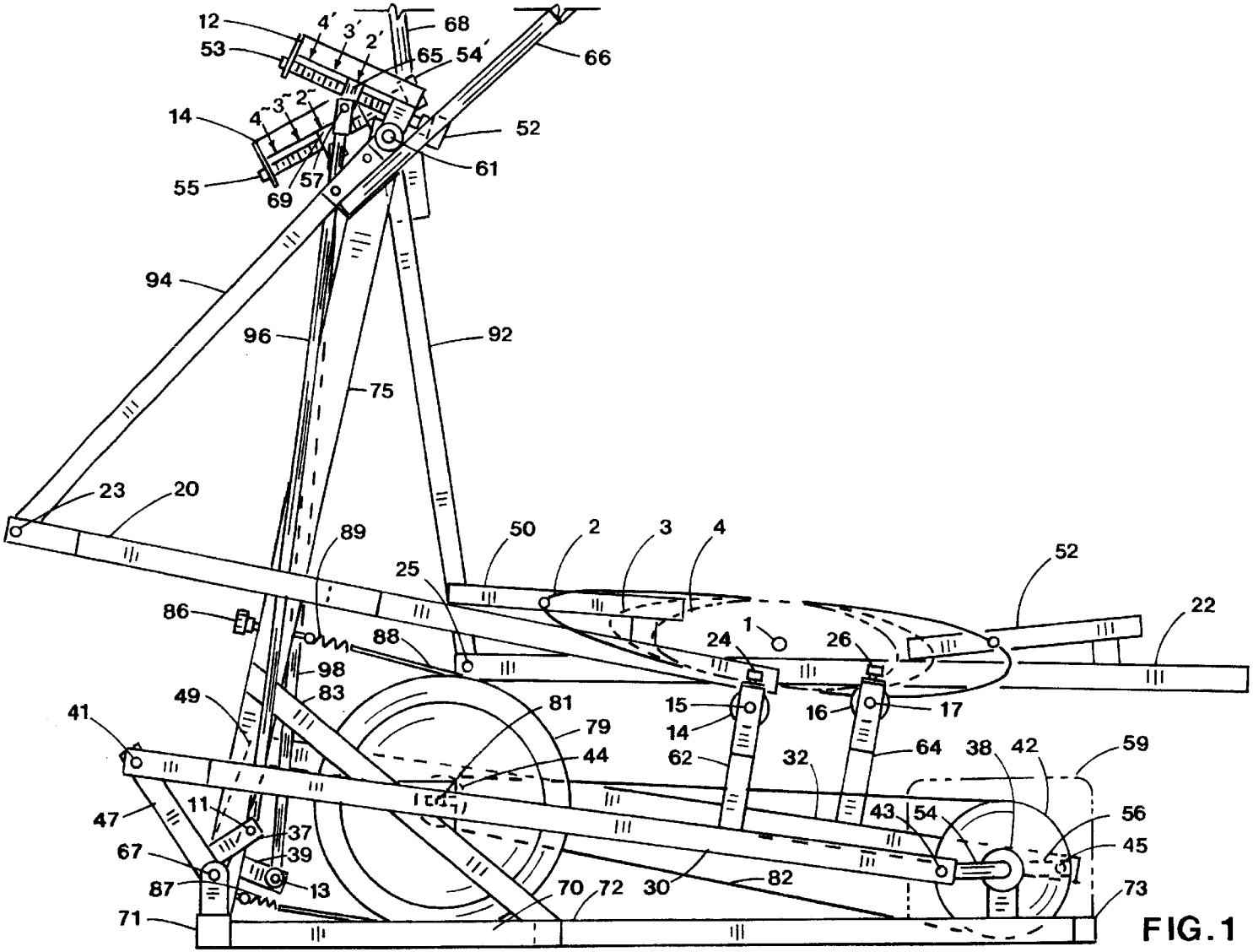
FIG. 1 is a right side elevation view of the preferred embodiment of an exercise machine constructed in accordance with the present invention adjusted for a longer pedal stride.
Figure 2:
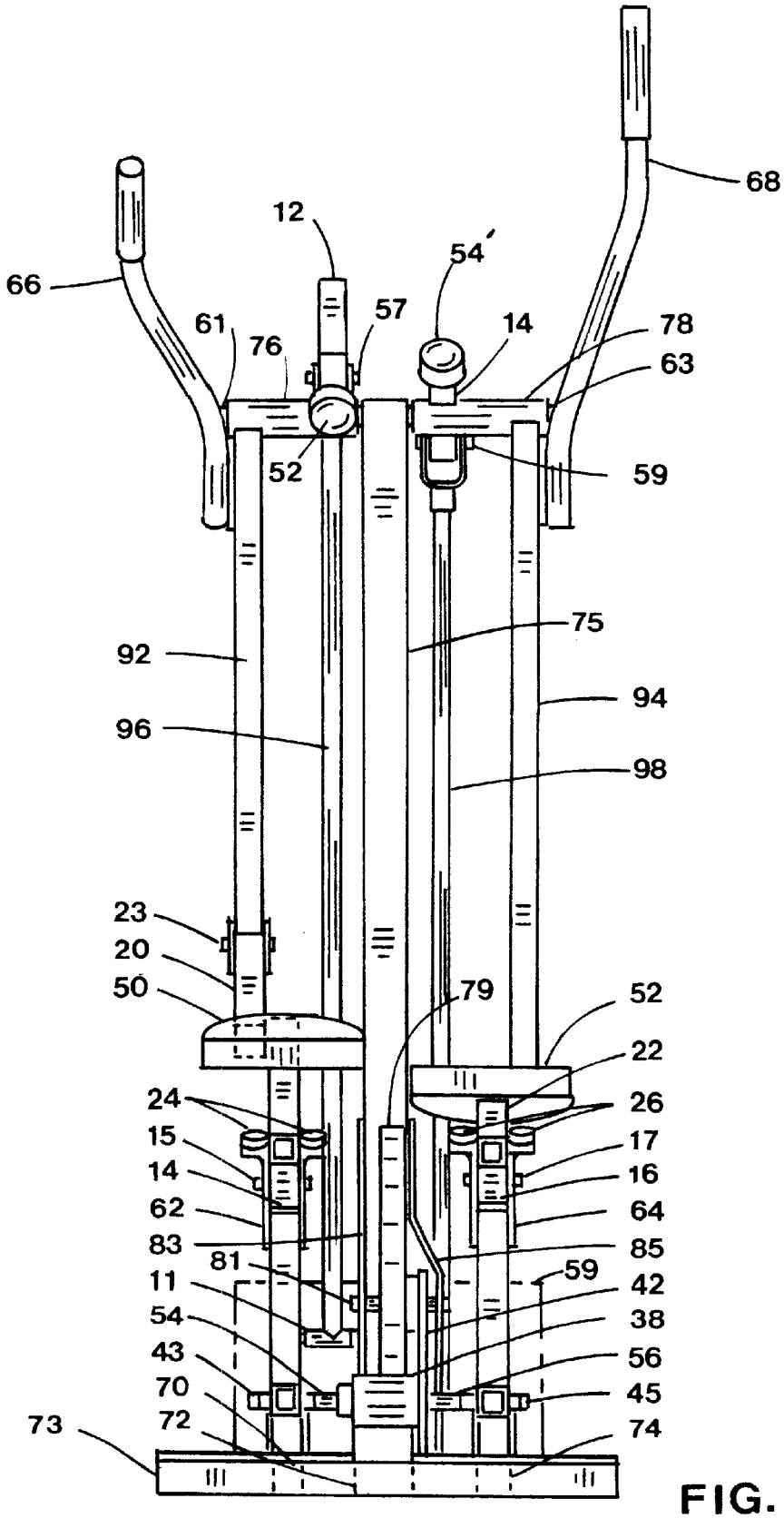
FIG. 2 is the rear view of the preferred embodiment shown in FIG. 1.

Referring to the drawings in detail, pedals 50 and 52 are shown in FIGS. 1 and 2 in generally their most forward and rearward positions of the first embodiment. Pedals 50 and 52 are supported by foot support members 20 and 22 which have pivots 23,25 in a first portion connecting to guides 92,94. Guides 92,94 are attached to guide tubes 76,78 which are connected to frame 75 at pivots 61,63.

Cranks 54 and 56 are connected in opposing directions by crankshaft journal 155 (not shown) which is rotatably secured to the framework 72 by bearing housing 38. Rocker links 47 and 49 are pivotally attached to crossover support member 71 at pivots 67 and 69, respectively. Coupler links 30,32 are connected to rocker links 47,49 at pivots 41,36 and to crank 54,56 at pivots 43,45. Cranks 54,56, rocker links 47,49 and coupler links 30,32 form a pair of crank assemblies. Shroud 59 covers crank 54,56 and a portion of coupler links 30,32.

Rollers 14,16 are rollably attached to coupler link extensions 62,64 at pivots 15,17. Coupler link extensions 62,64 are attached to coupler links 30,32. Rollers 14,16 are in rollable contact with foot support members 20,22 along with side support bearings 24,26 to provide up and down movement for the second portion of foot support members 20,22.

Rocker extensions 37,39 are attached to rocker links 47,49. Guide extensions 12,14 are attached to guide tube 76,78 which can rotate about pivots 61,63. Screws 53,55 with knobs 52,54' are rotatably attached to guide extensions 12,14. Pivot blocks 65,69 are threaded to screws 53,55 to move back and forth relative to pivots 61,63. Control links 96,98 connect rocker extensions 37,39 at pivots 11,13 to pivot blocks 65,69 at pivots 57,59. Rocker extensions 37,39, guide extensions 12,14 and control links 96,98 form a pair of control assemblies.

The longest pedal curve 2 results with pivot blocks 65,69 in positions 2',2". Intermediate length pedal curve 3 results with pivot blocks 65,69 moved to positions 3',3" by turning knobs 52,54. The shorter pedal curve 4 occurs with further turning of knobs 52,54' to move the pivot blocks 65,69 to positions 4',4". Actuators (not shown) could also be used to rotate screws 53,55 using a control system (not shown). A similar screw arrangement could be used to move pivots 11,13 along rocker extensions 37,39 with similar stride length and geometry changes.

Handles 66,68 are attached to guides 92,94 at pivots 61,63 for arm exercise. Frame members 70,72,74 are attached to frame members 71,73 configured to be supported by the floor. Frame upright 75 is connected to crossover member 71 and to frame member 72 by braces 83,85.

Flywheel 79 is rotatably supported by braces 83,85 at pivot 81. Sprockets 42 and 44 engage flywheel 79 and cranks 54,56 with chain 82. Load resistance is provided by friction belt 88 wrapped around flywheel 79 terminating at springs 87,89. Adjustment knob 86 varies the tension in friction belt 88. Alternately, an actuator (not shown) with control system (not shown) could be used to control the belt tension during operation.

Application of body weight on the pedals 50,52 and force applied at the arm levers 66,68 cause the flywheel 79 to rotate for a gain in momentum while the pedals 50,52 follow any pedal curve selected between curves 2 and curve 4. The flywheel 79 momentum will carry the linkage system through any dead center positions of the crank 54,56. The pedals 50,52 and arm levers 66,68 can be operated to drive the flywheel 79 in either direction of rotation.

Figure 3:
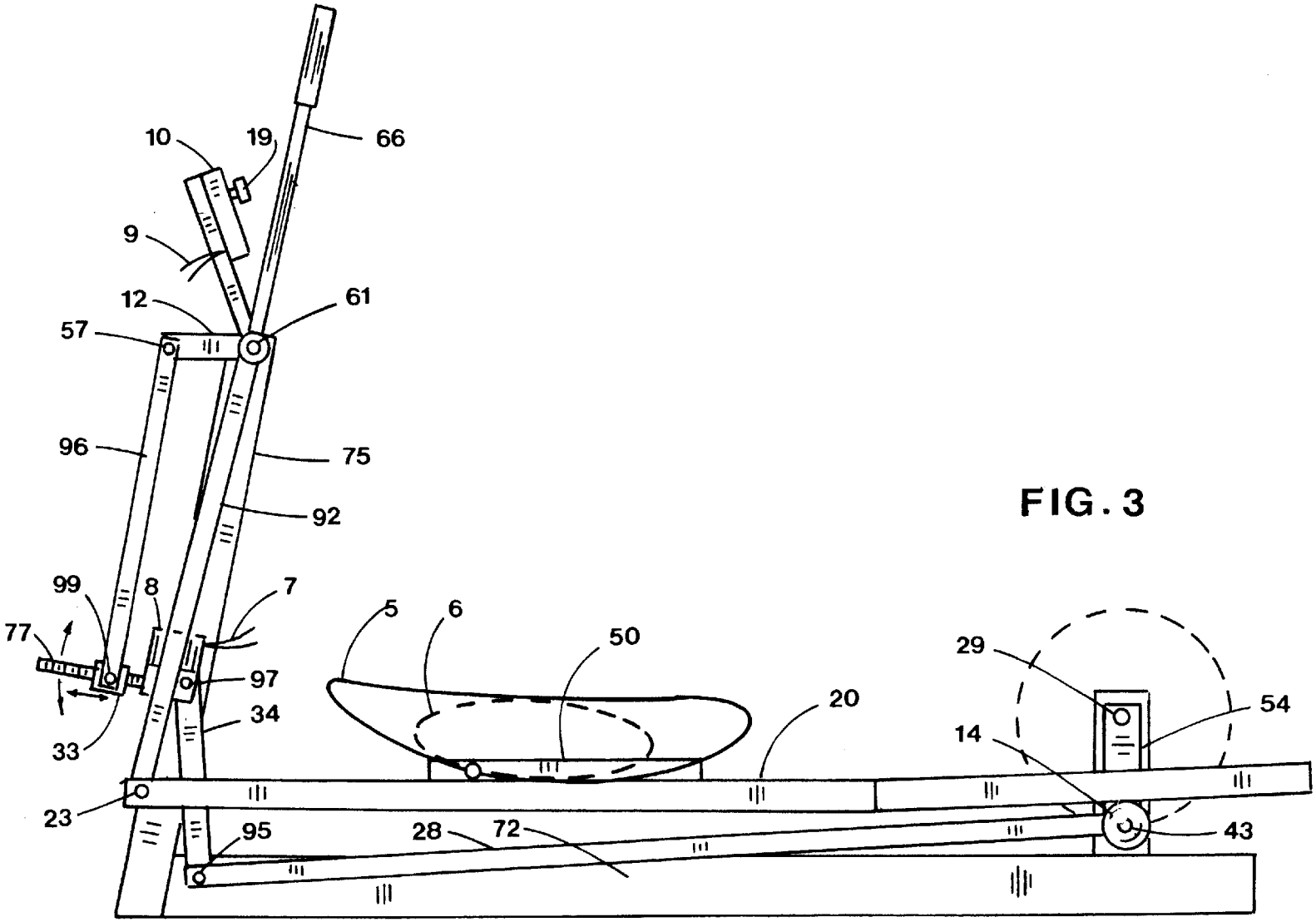
FIG. 3 is a side elevation view of an alternate embodiment.

In an alternate embodiment, pedal 50 is shown in the lowermost position in FIG. 3. Only one side of the exercise machine is shown without load resistance for clarity. Roller 14 is rotatably connected to crank 54 at pivot 43. Rocker link 34 is connected to frame upright 75 at pivot 97. Coupler link 28 is connected to rocker link 34 at pivot 95 ant to crank 54 at pivot 43. Rocker link 34, coupler link 28 and crank 54 form a crank assembly.

Actuator 8 is attached to rocker link 34 with screw 77 protruding. Pivot block 33 moves closer or further away from pivot 97 with screw 77 rotation. Control link 96 connects guide extension 12 at pivot 57 to pivot block 33 at pivot 99. Control link 96, guide extension 12 and screw 77 form a control assembly. Control system 10 is connected to actuator 8 with wiring 7,9 by conventional means (not shown). The actuator 8 can be varied during operation to reduce the stride length and geometry of pedal curve 5 to pedal curve 6 as desired by the operator using knob 19 or by automatic program. Alternately, a knob (not shown) could be adapted to screw 77 for manual adjustment.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of crank assemblies, each said crank assembly including said crank, a rocker link, said rocker link pivotally connected to said framework and a coupler link, said coupler link pivotally connected to said rocker link and said crank;

a pair of rollers, each said roller operably associated with said crank assembly and said foot support member to cause said second portion of said foot support member to have generally up and down movement;

a pair of guides, each said guide pivotally connected to said foot support member and said framework;

a pair of control assemblies, each control assembly operably associated with said crank assembly and said guide to cause said first portion of said foot support member to have generally back and forth movement;

said pedal configured to move relative to said framework when the foot of the user is rotating said crank whereby said pedal follows an elongate curve path.

2. The exercise machine according to claim 1 wherein said elongate curve path is generally elliptical in shape.

3. The exercise machine according to claim 1 further comprising a means for adjustment, said means for adjustment configured to cause the geometry of said elongate curve to change.

4. The exercise machine according to claim 3 wherein said means for adjustment includes an actuator, said actuator operably associated with said control assembly to change the back and forth movement of said guide.

5. The exercise machine according to claim 1 wherein said control assembly comprises a guide extension, said guide extension attached to said guide, a rocker link extension, said rocker link extension attached to said rocker link, and a control link, said control link operably associated with said rocker link extension and said guide extension.

6. The exercise machine according to claim 5 wherein said control link is connected to said guide link extension with a pivot whereby said pivot is movable relative to said guide link extension.

7. The exercise machine according to claim 5 wherein said control link is connected to said rocker link extension with a pivot whereby said pivot is movable relative to said rocker link extension.

8. The exercise machine according to claim 3 wherein said means for adjustment is positioned proximate the upper body of the operator for easy adjustment while standing on the exercise machine.

9. The exercise machine according to claim 4 further comprising a control system, said control system allowing said actuator to be changed during operation of said exercise machine.

10. The exercise machine according to claim 1 further comprising a means for arm exercise, said means for arm exercise operably associated with said pedal movement.

11. The exercise machine according to claim 10 wherein said means for arm exercise comprises a pair of handles, each said handle attached to said corresponding guide.

12. The exercise machine according to claim 1 further comprising a shroud, said shroud positioned below said foot support members to enclose said crank and at least a portion of said coupler links.

13. The exercise machine according to claim 1 further comprising a flywheel, said flywheel rotatably connected to said framework and operably associated with said crank.

14. The exercise machine according to claim 1 further comprising a load resistance, said load resistance operably associated with said crank, a means for adjustment of said load resistance and, a control system, said control system positioned within reach of the operator whereby said load resistance can be varied during operation of said exercise machine.

15. The exercise machine according to claim 1 wherein said pedal is positioned intermediate said first and said second portion of said foot support member to cause said pedal to follow an elliptical curve.

16. The exercise machine according to claim 1 wherein said roller is rotatably connected to said crank whereby said roller is in rollable contact with said foot support member.

17. The exercise machine according to claim 1 wherein said roller is rotatably connected to said coupler link whereby said roller is in rollable contact with said foot support member.

18. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of crank assemblies, each said crank assembly including said crank, a rocker link, said rocker link pivotally connected to said framework and a coupler link, said coupler link pivotally connected to said rocker link and said crank;

a pair of rollers, each said roller operably associated with said crank assembly and said foot support member to cause said second portion of said foot support member to have generally up and down movement;

a pair of guides, each said guide pivotally connected to said foot support member and said framework;

a pair of control assemblies, each control assembly comprising a rocker link extension, said rocker link extension attached to said rocker link, a guide extension, said guide extension attached to said guide and a control link, said control link operably associated with said rocker link extension and said guide extension to cause said first portion of said foot support member to have generally back and forth movement;

said pedal configured to move relative to said framework when the foot of the user is rotating said crank whereby said pedal follows an elongate curve path.

19. The exercise machine according to claim 18 further comprising a means for arm exercise, said means for arm exercise operably associated with said guide.

20. The exercise machine according to claim 18 further comprising a coupler extension, said coupler extension attached to said coupler link whereby said roller is positioned on said coupler extension offset relative to a line connecting the crank pivot and rocker pivot of said coupler link.

21. The exercise machine according to claim 18 further comprising a means for adjustment, said means for adjustment configured to cause the geometry of said elongate curve to change.

22. The exercise machine according to claim 21 wherein said means for adjustment includes a control system, said control system positioned within easy reach of the operator and, an actuator, said actuator operably associated with said control system and said control assembly to change the back and forth movement of said guide during operation of said exercise machine.

23. The exercise machine according to claim 18 wherein said means for adjustment is manual, said manual means for adjustment positioned for easy access by said user.

24. The exercise machine according to claim 18 wherein said control link is connected to said rocker link extension with a pivot whereby said pivot is movable relative to said rocker link extension.

25. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of crank assemblies, each said crank assembly including said crank, a rocker link, said rocker link pivotally connected to said framework and a coupler link, said coupler link pivotally connected to said rocker link and said crank;

a pair of rollers, each said roller operably associated with said crank assembly and said foot support member to cause said second portion of said foot support member to have generally up and down movement;

a pair of guides, each said guide pivotally connected to said foot support member and said framework;

a pair of control assemblies, each control assembly operably associated with said crank assembly and said guide to cause said first portion of said foot support member to have generally back and forth movement;

a means for adjustment, said means for adjustment operably associated with said control assembly and said guide;

said pedal configured to move relative to said framework when the foot of the user is rotating said crank whereby said pedal follows an elongate curve path that can be changed by said means for adjustment.

26. The exercise machine according to claim 25 further comprising a means for arm exercise, said means for arm exercise operably associated with said exercise machine.

27. The exercise machine according to claim 25 wherein said means for adjustment includes a control system, said control system positioned within easy reach of the operator and, an actuator, said actuator operably associated with said control system and said control assembly to change the back and forth movement of said guide during operation of said exercise machine.

28. The exercise machine according to claim 25 wherein said means for adjustment is manual, said manual means for adjustment positioned for easy access by said user.

29. The exercise machine according to claim 25 wherein said control assembly comprises a guide extension, said guide extension attached to said guide, a rocker link extension, said rocker link extension attached to said rocker link, and a control link, said control link operably associated with said rocker link extension and said guide extension.

30. The exercise machine according to claim 29 wherein said control link is connected to said rocker link extension with a pivot whereby said pivot is movable relative to said rocker link extension.

31. The exercise machine according to claim 29 wherein said control link is connected to said guide link extension with a pivot whereby said pivot is movable relative to said guide link extension.

* * * * *